US007076897B2

(12) United States Patent
Bassi

(10) Patent No.: US 7,076,897 B2
(45) Date of Patent: Jul. 18, 2006

(54) METHOD AND APPARATUS FOR LOADING ARTICLES SUCH AS STOCKINGS, SOCKS AND THE LIKE ONTO THE SHAPES OF AN IRONING MACHINE

(75) Inventor: Gino Bassi, San Giovanni in Persiceto Bologna (IT)

(73) Assignee: Santoni S.p.A. (IT)

( * ) Notice: Subject to any disclaimer, the term of this patent is extended or adjusted under 35 U.S.C. 154(b) by 148 days.

(21) Appl. No.: 10/793,474

(22) Filed: Mar. 4, 2004

(65) Prior Publication Data

US 2004/0244237 A1 Dec. 9, 2004

(30) Foreign Application Priority Data

Mar. 7, 2003 (IT) ..... FI2003A0059

(51) Int. Cl.
*D06F 71/38* (2006.01)
*A41H 43/02* (2006.01)

(52) U.S. Cl. ..... 38/7; 223/40

(58) Field of Classification Search ..... 38/7, 38/12, 14; 223/1, 39, 40, 75, 76, 77, 41, 223/42, 43
See application file for complete search history.

(56) References Cited

U.S. PATENT DOCUMENTS

| | | | | |
|---|---|---|---|---|
| 3,097,770 | A * | 7/1963 | Garron | 223/1 |
| 4,643,340 | A * | 2/1987 | Bailey | 223/40 |
| 4,658,995 | A * | 4/1987 | Teague | 223/76 |
| 5,605,260 | A * | 2/1997 | Olivas Coll | 223/76 |
| 6,155,466 | A * | 12/2000 | Migliorini | 223/77 |
| 6,516,979 | B1 * | 2/2003 | Migliorini | 223/75 |
| 6,913,173 | B1 * | 7/2005 | Manini | 223/75 |

* cited by examiner

*Primary Examiner*—Ismael Izaguirre
(74) *Attorney, Agent, or Firm*—McGlew & Tuttle, PC

(57) ABSTRACT

The invention refers to a method and apparatus for loading articles such as stockings, socks and the like onto an ironing machine being provided with relevant support shapes; the apparatus (1) comprises: a tubular chamber (3) with an inlet section (20) for the introduction of articles (M), connected upstream with a supply machine (PP) able to transfer the articles according to a preset order; a temporary support element (4) on which the article (M) can be filtered, said support element (4) being located within said chamber (3) with its longitudinal axis (x—x) coincident with and parallel to that of the same chamber (3) and subdivided into two semi-parts (44) which can move close to and, respectively, away from each other; means (5) for the removal and positioning of the articles (M) able to remove an article (M) from said temporary support element (4) and to fit it onto a shape (6).

13 Claims, 11 Drawing Sheets

AU
31
M
44
V
55
F
F

Y
L
Y

AU
31
M
3
44
50
5

5
55
55
L
M
50
55

AU
X
31
3
2
M
44
32
40
X
55
32
44
40

METHOD AND APPARATUS FOR LOADING ARTICLES SUCH AS STOCKINGS, SOCKS AND THE LIKE ONTO THE SHAPES OF AN IRONING MACHINE

The present invention refers to a method and apparatus for loading articles such as stockings, socks and the like onto the shapes of an ironing machine.

BACKGROUND OF THE INVENTION

It is known that after the articles of a type above mentioned have been manufactured, they are subjected to an ironing process which provides for the loading thereof manually onto suitable flat shapes. The operation for loading the articles is carried out manually by an operator and some drawbacks can be pointed out relevant to said loading procedure. In fact, the operation carried out by the operator is extremely repetitive and, therefore, work shifts must be programmed by taking into account pauses and idle times due to turnover of staff, possible human errors, etc; besides, the final product does not benefit of particular value added deriving from the manual execution of such operation.

SUMMARY OF INVENTION

The object of this invention is to overcome the above drawbacks. In particular, the present invention makes it possible to automate the loading of articles such as stockings, socks and the like onto the shapes of an ironing machine.

This result has been achieved, according to the invention, by adopting the idea of providing a method and apparatus having the characteristics indicated in the independent claims. Further characteristics being set forth in the dependent claims.

The present invention allows automatically operating the loading of articles such as stockings, socks and the like onto the shapes of an ironing machine or other machines and equipment. Moreover, an apparatus according to the invention is relatively simple to make, cost-effective and reliable also after a prolonged service life.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein:

FIGS. 1A, 1B, 2A, 2B, 2C, 3A, 3B, 4A, 4B, 4C, 5A, 5B, 5C, 6A, 6B shows schematically some subsequent operating steps relating to the automatic loading of shapes onto an ironing machine, according to the invention, wherein FIGS. 1A, 2A, 4A, 5A are side views, FIGS. 1B, 2B, 3A, 4B, 5B, 6A are front views and FIGS. 2C, 3B, 4C, 5C, 6B are plan view from above;

DETAILED DESCRIPTION OF THE INVENTION

Figure 1A:
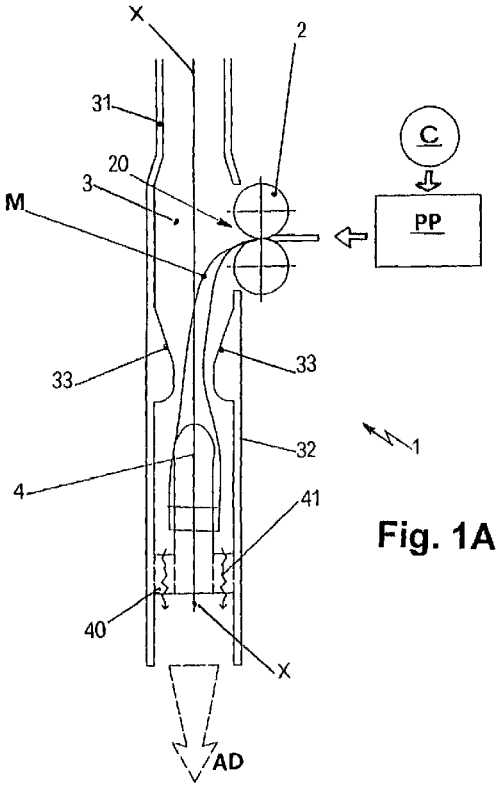

Described herebelow, with reference to FIGS. 1A–6B, is an example of how the apparatus according to the invention operates.

An apparatus 1 according to the invention can be used for the automatic loading of articles M such as stockings, socks and the like, having their toes closed, onto an ironing machine provided with flat shapes 6 upon which the articles must be fitted in order to be subjected to relevant ironing operations.

The articles M arrive at the apparatus 1 in question after being removed from a container C wherein they are disposed in bulk. The articles M are then subjected to a single-handling and orientation process. The schematic block PP represents a well known device, so-called "pick and place" in jargon, that is, a device able to remove one or more articles from the basket and to feed one article at a time with such an orientation as required by the apparatus disposed downstream thereof. In the illustrated example, the device PP sends one article at a time with the hem end forward.

The apparatus 1 comprises an openable tubular chamber 3 having a section 20 for the introduction of articles defined by two rollers 2 through which the article M—arriving from the single-handling and orienting device PP, as above mentioned—is made to pass.

The chamber 3 is acted upon by suitable forced-suction or ventilation means which are able to aspirate either from below or from above, as schematically represented by the arrows AD and AU in the drawings.

The chamber 3 receives a central pin 4 with its longitudinal axis x—x vertically disposed, as shown in the drawings. The said pin 4, which defines a temporary support element for the articles, has a substantially cylindrical shape with rounded tip and is subdivided into two semi-parts 44 which are fixed to corresponding movable walls 32 of the chamber 3, so as to allow the two semi-parts to move close to and away from each other. The attachment of the pin 4 is carried out by means of two supporting semi-bases 40 provided with longitudinal through holes 41 disposed circumferentially to said pin 4; in addition, between the pin 4 and the section 20 for the introduction of articles M there is provided a converging-diverging conduit 33.

The two semi-parts 44 are movable close to and away from each other; this characteristic can be obtained either providing driving means for both the semi-parts 44, or by keeping one of them stationary and moving only the other.

During the operation of the apparatus 1, the article M in transit is introduced into the chamber 3 while it is retained by the rollers 2 with its hem portion forward.

Figure 1B:
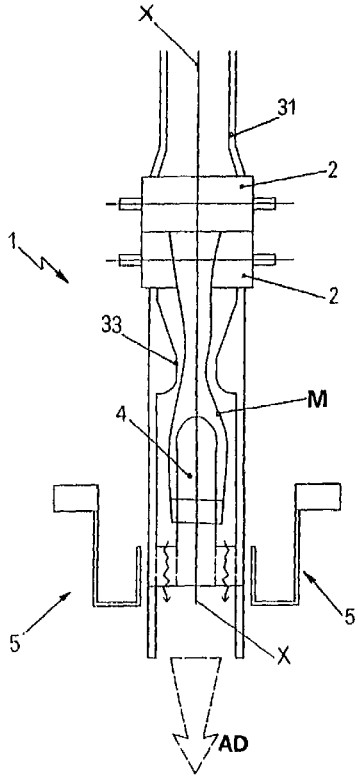

The activation of the suction system AD, with the air flow directed downward, will determine, owing to the its passing through the conduit 33 and because of the circumferential disposition of the holes 41, the opening or widening of the article in correspondence of the hem, so as to allow the article to be fitted on the pin 4. This step is depicted in FIGS. 1A and 1B.

Figures 2A, 2B, 2C, 3A, 3B:
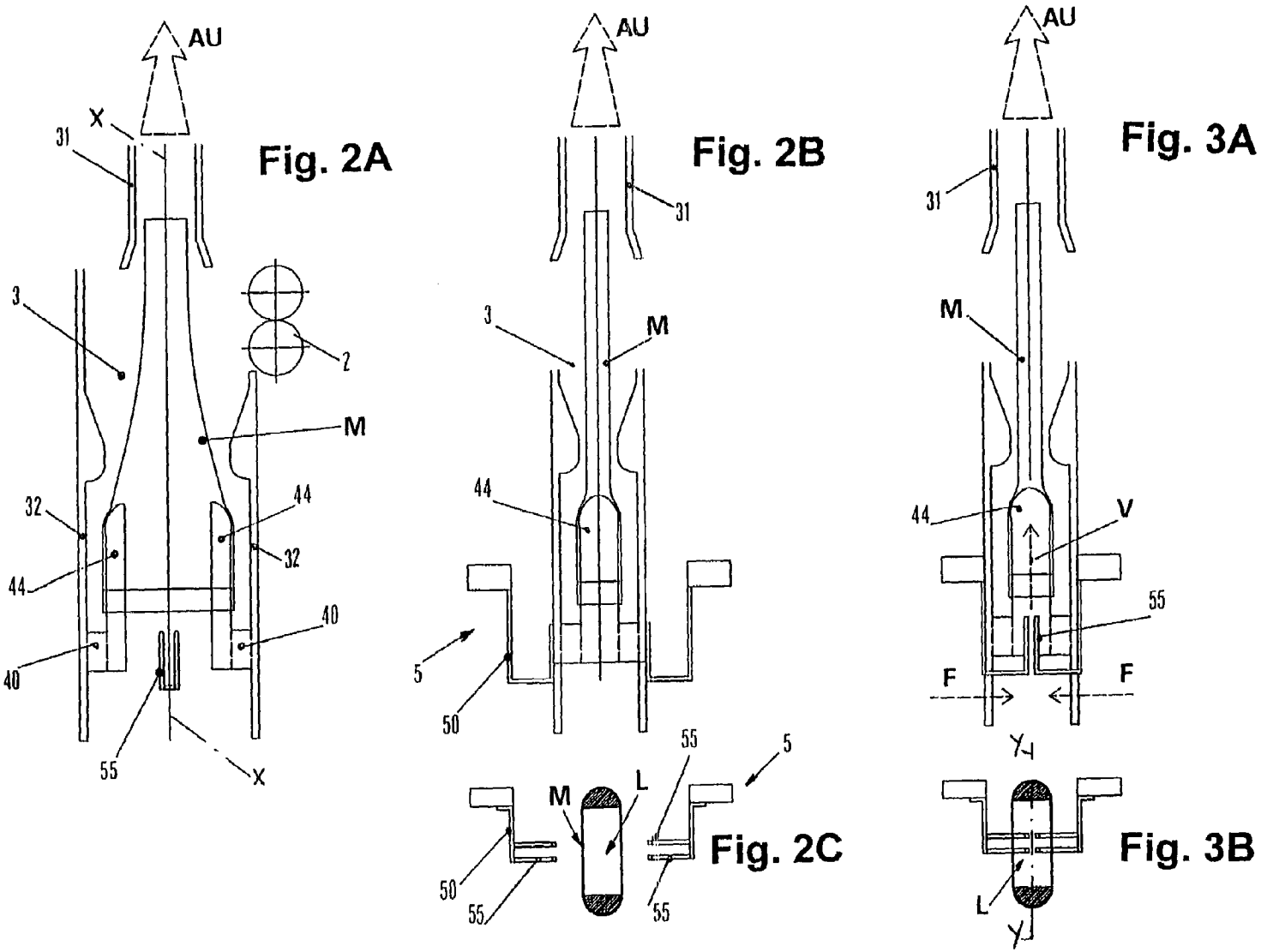

Once the article M is upon the spin 4, the two semi-parts 44 are moved away from each other, thereby causing a corresponding widening of the article, as can be seen in FIGS. 2A, 2B and 2C. In this step, the suction from below AD, acting on the chamber 3, is switched off; the article is released from rollers 2 and its free part (the toe portion) is called back upward by the aspiration (indicated by AU) acting through the conduit 31 which delimits the chamber 3 on top.

The apparatus comprises removal and positioning means 5 able to take the articles out of the pin 4 and fit them onto the shapes of the ironing machine. In particular, the means 5 comprise two removal members 50 opposite to each other, each of which exhibits two parallel rod-like elements or arms 55 slightly spaced from each other. In the particular embodiment illustrated, the arms 55 are substantially L-shaped, with their free ends disposed vertically. The two removal members 50 can be moved vertically and moved close to or away from each other. The relevant driving means are best described later on.

As best viewable in FIG. 2C, the two semi-parts 44 of pin 4, when in open configuration, define a rectangular opening L, with longitudinal axis y—y, the short sides of which are represented by the inner faces of the two semi-parts 44, and the long sides are represented by portions of the wide-opened article M. In the subsequent step, as illustrated in FIGS. 3A and 3B, the removal means 5, which are at a level below the pin 4 in vertical direction, are moved close to each other, in a direction orthogonal to that in which the two semi-parts are driven (see arrow F), until the arms 55 enter the said opening L defined by the two semi-parts 44. Thereafter, the removal means 5 are lifted (see arrow V) as far as to bring the arms 55 in contact with the article M being fitted on the two semi-parts 44. The arms are lifted further up and moved away from each other: in practice, as best viewable in FIG. 4B, the arms 55 cover a travel which is vertical in the first length V1 and, thereafter, they are still directed upwards but move also away from each other (length V2). Such movement of the arms 55 away from each other determines a tensioning of the article in a direction orthogonal to that relating to the previous tensioning operated on the same article by the semi-parts 44 moving away from each other, as described above.

As the arms 55 keep moving upwards, they get over the upper end of semi-parts 44, thereby releasing the semi-parts 44 from the article M supported by them.

Figures 4A, 4B, 4C:
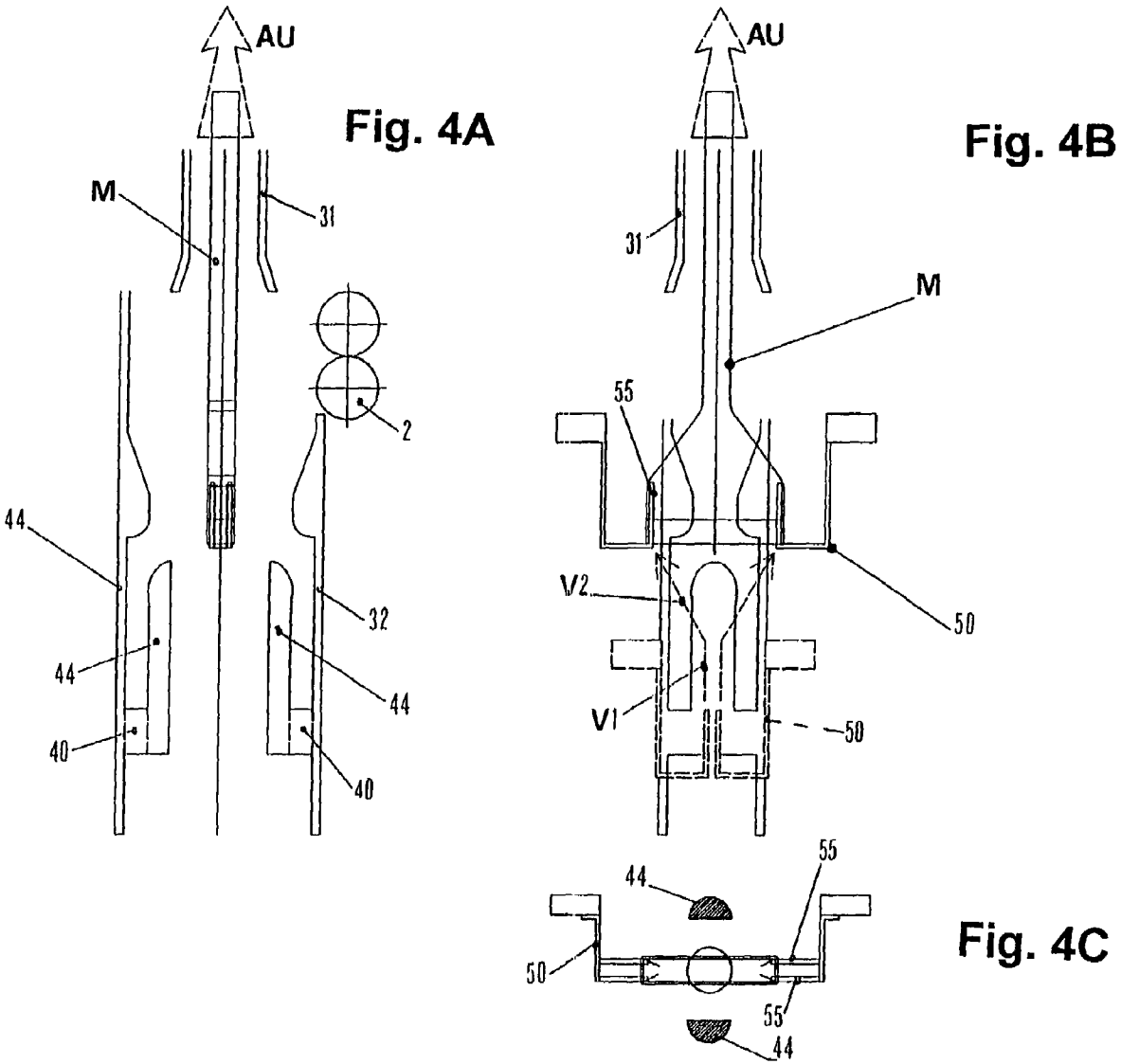
Figure 5A:
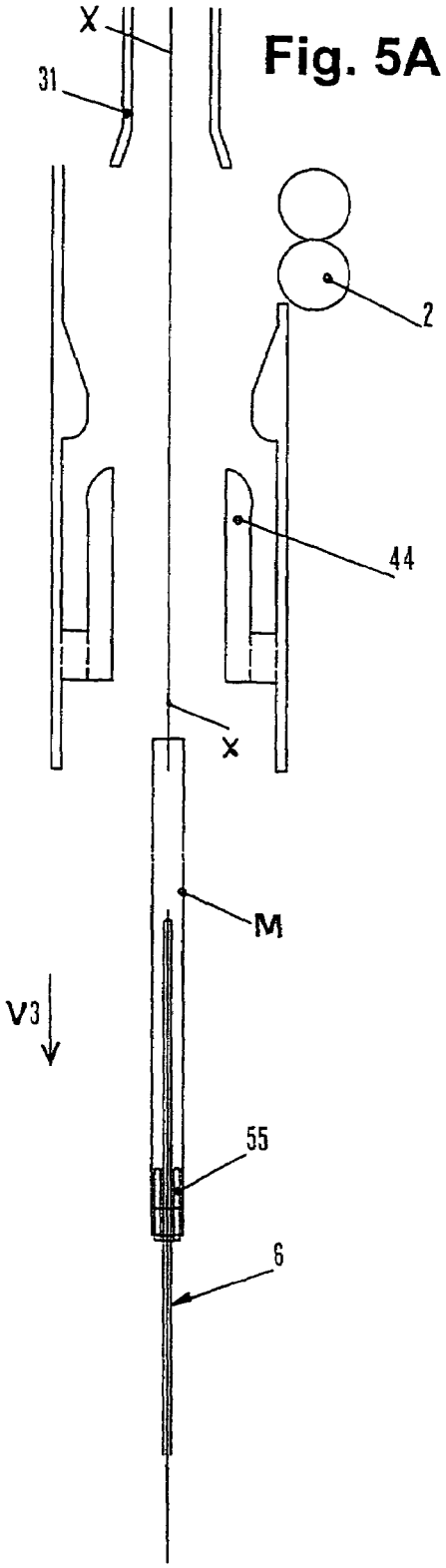
Figure 5B:
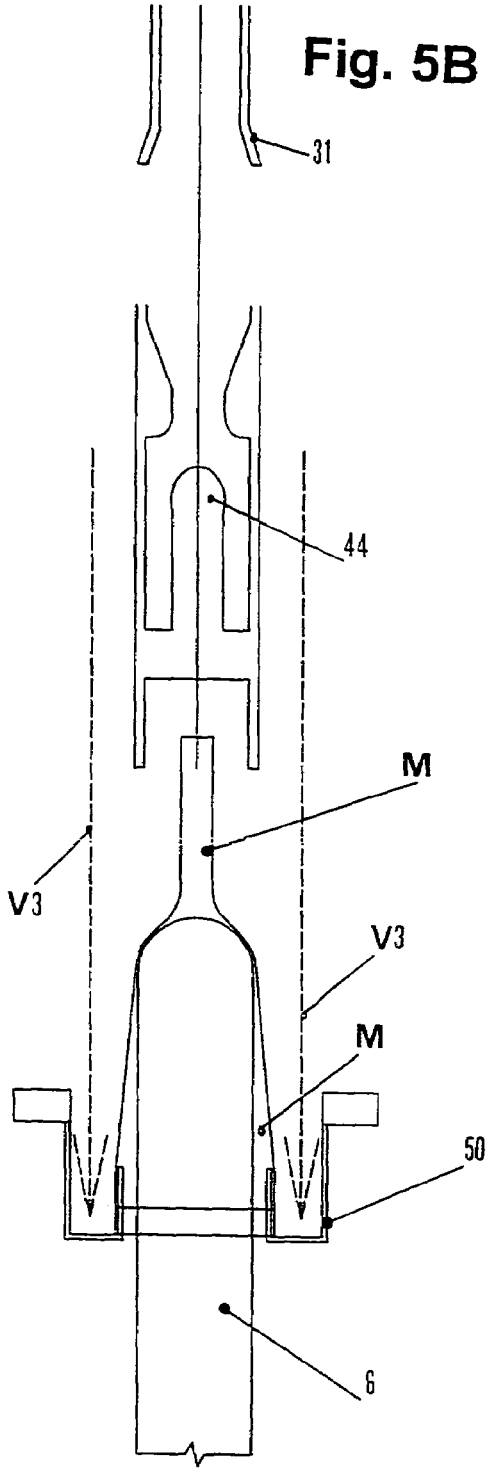
Figure 5C:
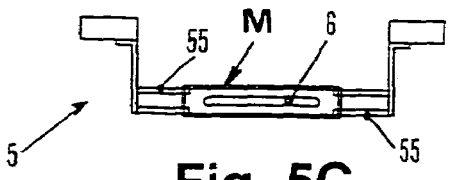

At this point (see FIGS. 5A, 5B and 5C), the arms 55 reverse their motion and move downwards (direction V3) by fitting the article M onto a shape 6 which, in the meantime, has reached a position below the chamber 3. In this step, the semi-parts 44 are still stretched apart and do not interfere with the article M which, as best viewable in FIG. 4C, is kept stretched within an internal region of the semi-parts 44 which is not taken over by them.

Figure 6A:
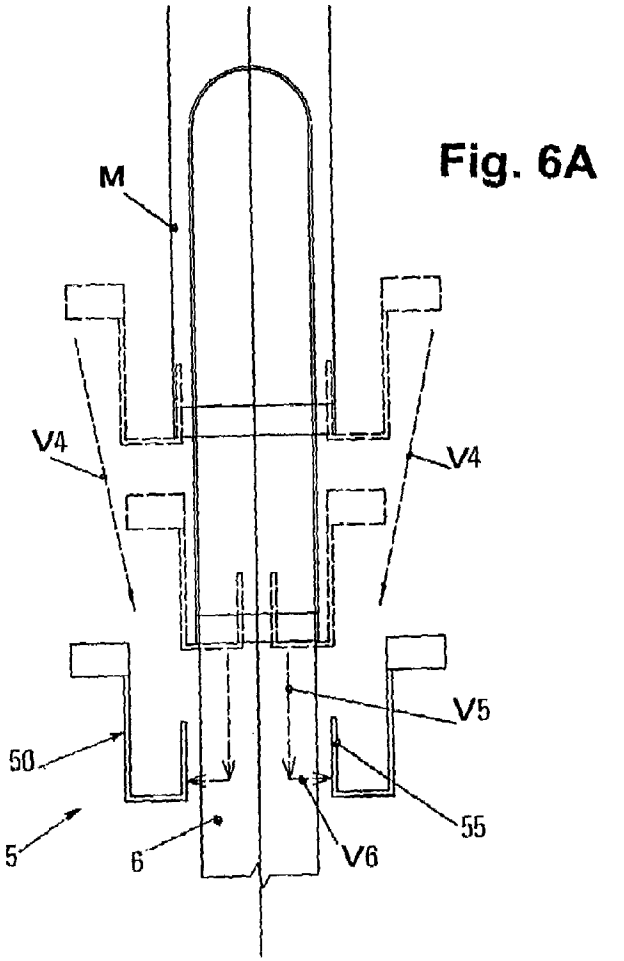
Figure 6B:
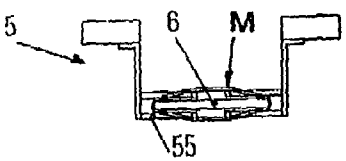

Once the article M is fitted completely onto the shape 6, the arms 55 are moved close to each other (length V4), lowered (length V5) and, then moved away (V6) after having released the article M, as illustrated in FIGS. 6A and 6B.

Afterwards, the apparatus 1 begins the following cycle, with another article M fitted on the pin 4.

Figure 7:
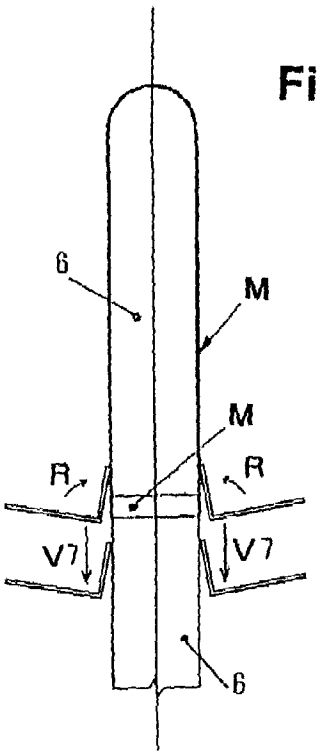
FIG. 7 is a schematic front view relating to a different embodiment of the step shown in FIGS. 6A and 6B.

Shown in FIG. 7 is a further embodiment of the last step, described with reference to FIGS. 6A–B, relating to the release of the article by the arms 55 which have loaded them beforehand onto the shape 6. According to this example, the arms 55 are inclined (see arrows R in FIG. 7) as they keep moving downwards (arrow V7).

Following this, the arms 55 are moved away from each other and lifted up again for the next cycle. It should be understood that, for this embodiment, the arms 55 will have to be suitably driven to perform the above said displacements (R, V7).

To sum up, a method for loading articles such as stockings, socks and the like onto the shapes of an ironing machine, allows automatically removing the articles, orienting and loading them onto the relevant shapes. In particular, reference being made to the described example, the method includes the following operating steps:

fitting an article onto a temporary support element 4 (the pin 4) having a relevant longitudinal axis x—x and made up of two semi-parts 44 which are movable away from each other;

moving the two semi-parts 44 of the support 4 away from each other so as to stretch the article M to define, between the two semi-parts 44, an opening L whose longitudinal axis y—y is orthogonal to the axis x—x of support 4;

inserting, into the opening L thus defined, a pair of clamping members 50 which are movable parallel to said longitudinal axis x—x and transverse to the axis y—y of the opening L, that is, transverse with respect to the driving direction of semi-parts 44, and moving said clamping members 50 toward the semi-parts 44 so as to make the members 50 interact with the article M fitted onto the semi-parts 44;

moving the removal members 50 away from each other so as to stretch the article M along a direction orthogonal to the axis y—y of the opening L;

moving the removal members 50 further with respect to the semi-parts 44 so as to withdraw the article M from the latter;

moving the removal members which carry the article M in stretched configuration, onto a shape 6 so as to fit the article M onto the same shape.

Figure 8A:
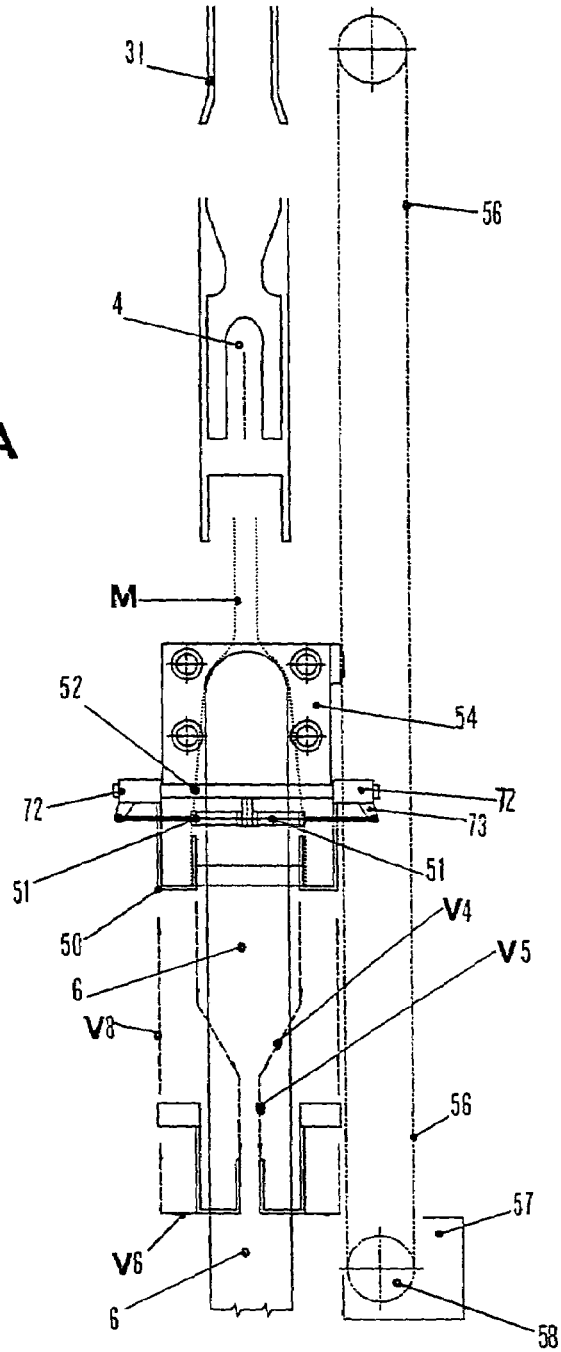
FIGS. 8A and 8B show a loading apparatus, for an individual shape, according to the invention, schematically shown in front view and in plan view from above, respectively.
Figure 8B:
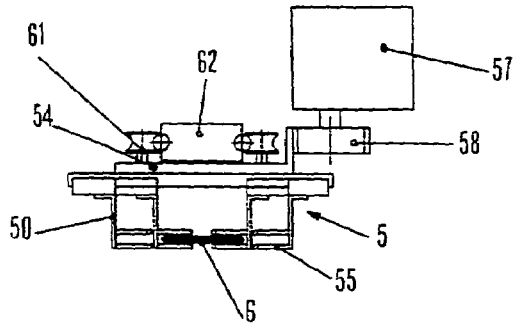

Shown in more details on FIGS. 8A and 8B are some parts of the apparatus, which are illustrated only schematically in FIGS. 1A to 7. In particular, these figures show the vertical and horizontal movements of the clamping means 5. The vertical movement is performed by means of a first carriage 54 provided with relevant wheels or small rollers 61 sliding along a vertical guide 62. The carriage 54 is fixed to a belt 56 moved by a pulley 58 being driven by a motor-reducer 57. The activation of the motor-reducer 57 is cause for the corresponding up and down displacement of carriage 54. Formed on the carriage 54 is a guide 52 on which two skids or bushes 72 are fitted. Each of these skids or bushes 72 exhibits a connection arm 73 to which is hinged the free end of one of two cylinders 51 solid to the guide 52. The two cylinders 51 are disposed opposite to one another, with the respective rods facing outwards. Secured to each skid 72 is one of the removal members 50 provided with arms 55. In other words, each of the removal members 50 is solid to the respective skid or bush 72 which slides along the guide 52; the activation of cylinders 51, that is, the displacement of the respective rods, will correspond to the horizontal movement of the removal members 50 and relevant arms 55. The attached drawings do not show the driving members of the semi-parts 44 of pin 4. These members may consist, for example, of pneumatic cylinders acting on the two semi-parts 44 and disposed, likewise the semi-parts 44, so as not to interfere with the movement of the removal members 50. The semi-parts 44 can be driven into motion, as above mentioned, by moving only one of the two semi-parts with respect to the other, the latter being kept stationary.

Figure 9A:
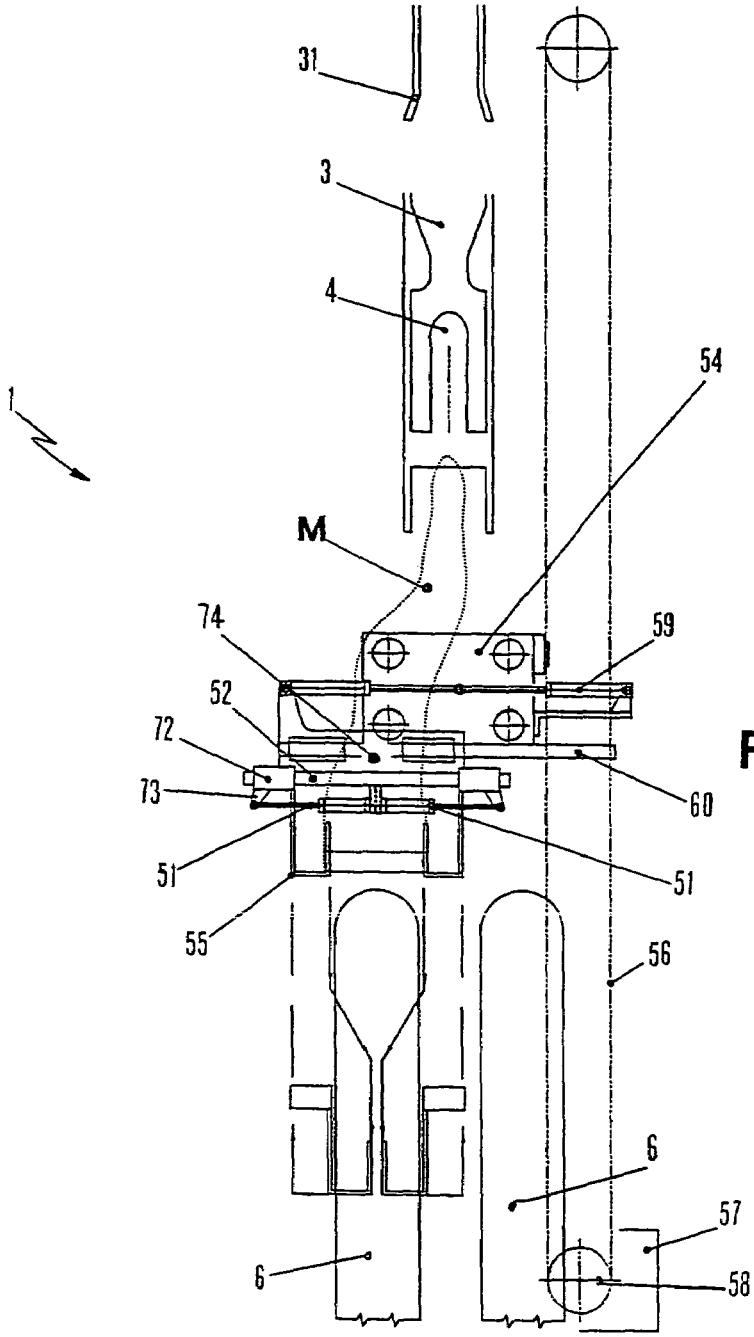
FIGS. 9A, 9B, 9C, 9D and 9E show a loading apparatus, for coplanar side-by-side disposed shapes, according to the invention, schematically shown, respectively, in front view (FIG. 9A) and in plan view from above (FIG. 9B) in relation to the loading of a first shape, in front view (FIG. 9C) in relation to an intermediate step, in front view (FIG. 9D) and in plan view from above (FIG. 9B) in relation to the loading of the other shape.
Figure 9B:
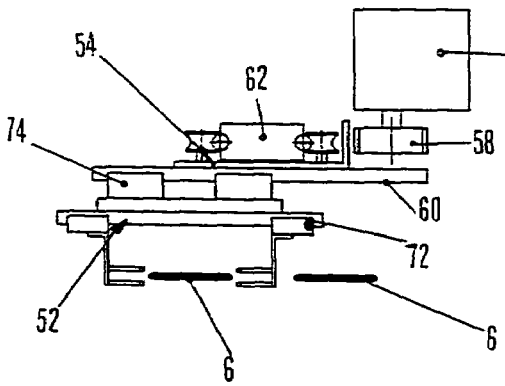
Figure 9C:
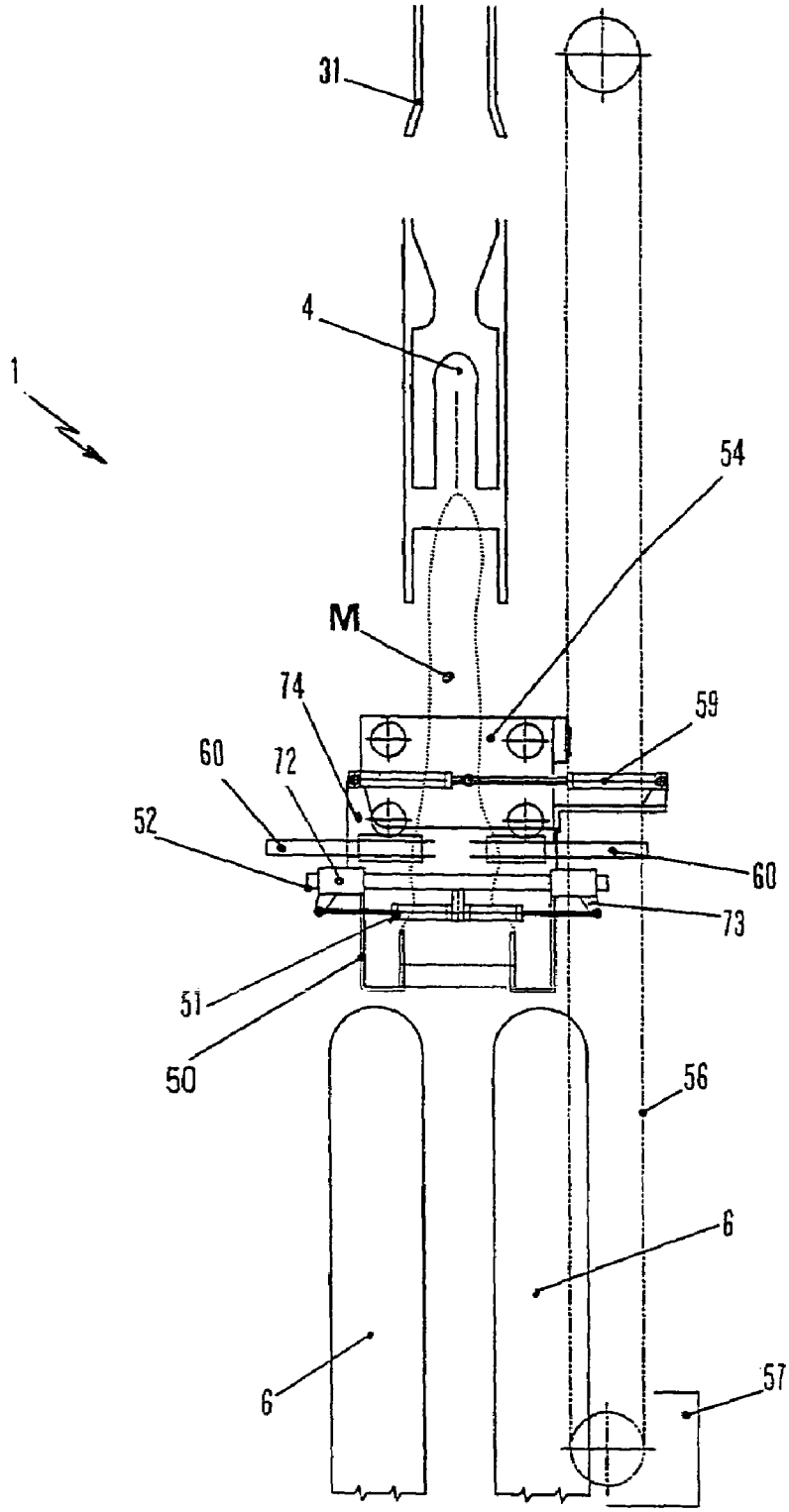

Shown in FIGS. 9A–C is an apparatus 1 for loading articles M onto coplanar, that is, side-by-side disposed shapes 6. In these drawings, and the others as well relating to exemplary embodiments of the invention, the same numerals have been used as those designating equivalent parts of the apparatus.

Figure 9D:
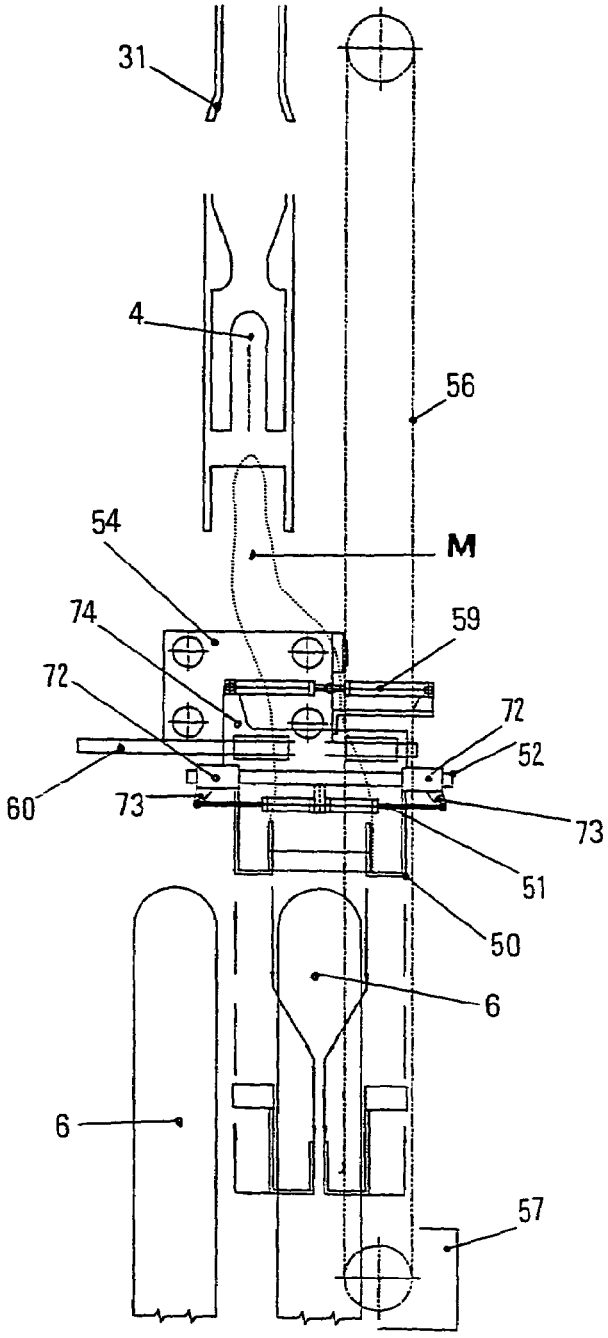
Figure 9E:
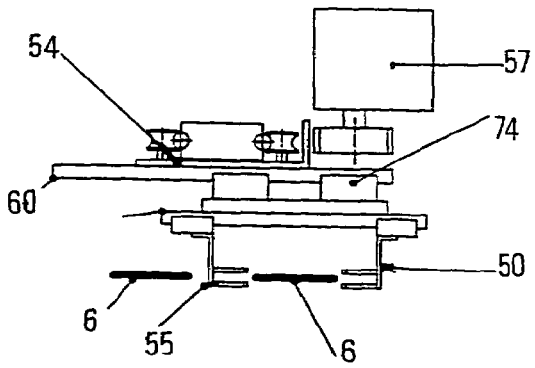

In the example of FIGS. 9A–C, the first carriage 54 is provided with an additional horizontal guide 60 along which a second carriage 74 slides, and on which a guide 52 is mounted having functions similar to those of guide 52, previously described in relation to the example for the loading of an individual shape, that is, a guide allowing a transverse (horizontal) displacement of the removal members 50 with the relevant arms 55. Also provided on the first carriage 54 are two cylinders 59 which act on the second carriage 74 to move the latter along the additional guide 60 of the first carriage 54. In practice, the cylinders 51 drive the removal members 50 into motion and, in particular, move them close to or away from each other, while the cylinders 59 displace the second carriage 74 relative to the first one to allow the translation of the removal members 5 from one shape 6 to the adjacent one. During the operation, after having completed the loading of a shape 6 (for example the one on the left side in FIGS. 9A–B), the apparatus 1 moves the removal means 5 along with a new article M (see FIG. 9C) in correspondence of the other shape (FIGS. 9D–E) and carries out the loading on the latter. The operations are repeated cyclically for the successive articles so as to load pairs of shapes disposed side-by-side.

Figure 10:
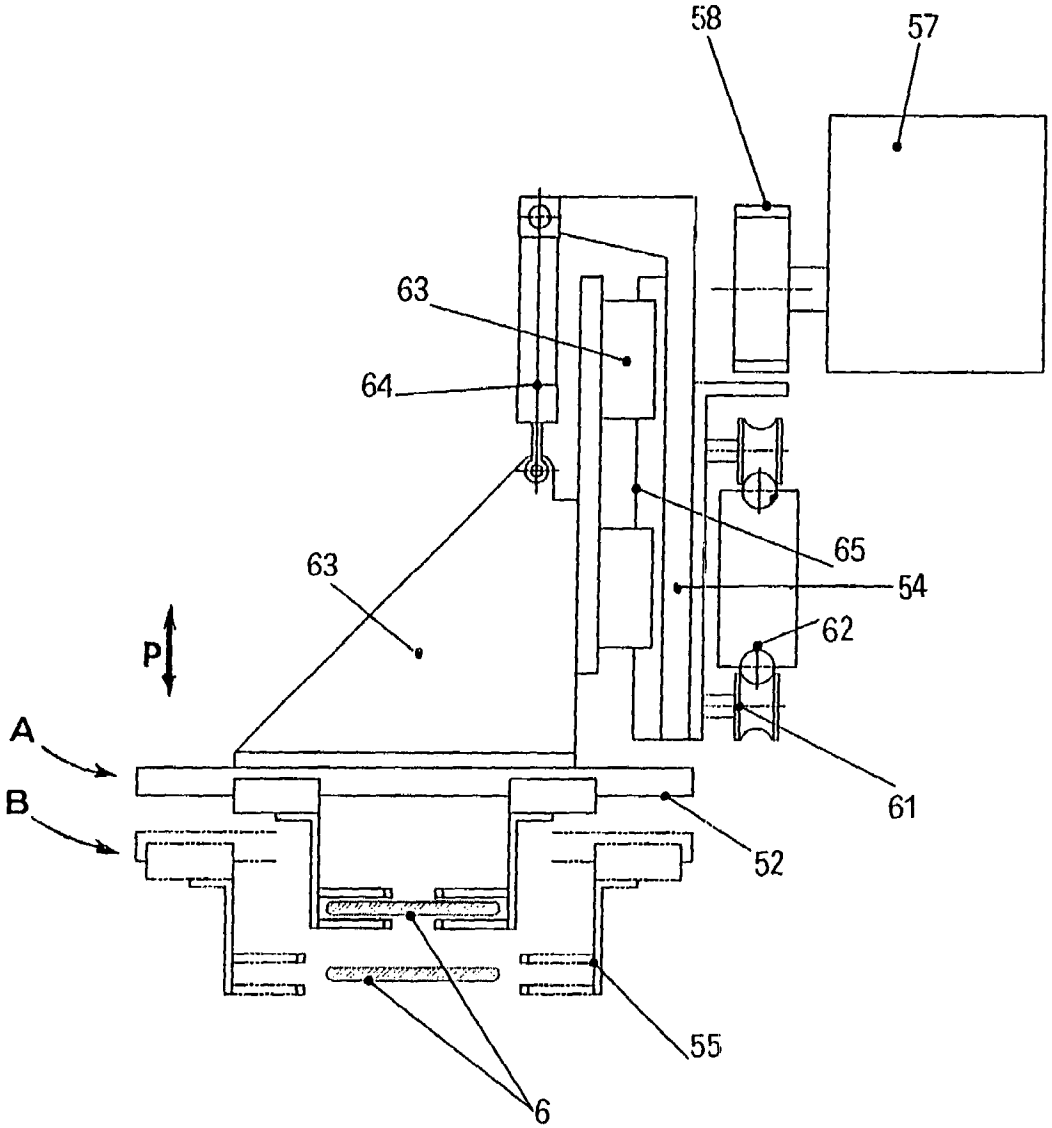
FIG. 10 shows an apparatus for loading frontally paired or parallel shapes, according to the invention, schematically represented in plan view from above.

In the example of FIG. 10, the shapes 6 to be loaded are disposed parallel, frontally paired. The carriage 54, which can be driven into vertically motion, as in the previous examples, along the guide 62 by means of the assembly made up of motor-reducer 57-pulley 58-belt 56, is provided with an additional guide 65 along which an additional carriage 63 is made to slide bi-directionally by a pneumatic cylinder 64. Provided on the additional carriage 63 is a guide 52 having functions like those of guides 52 of the previous examples, that is, it allows the transverse (horizontal) displacement of the removal members 50 with relevant arms 55; in this example, the driving cylinders (similar to the cylinders 51 of the preceding examples) have not been shown in the drawing for the sake of clarity. Such cylinders (not shown) determine, as in the previous examples, the movement of arms 55, in particular their moving close to and away from each other, while the cylinder 64 causes the displacement of the additional carriage 63 with respect to the first carriage 54, thereby allowing the translation (according to arrow P in FIG. 10) of the removal means 5 from one shape 6 to that parallel thereto. The position taken up by the removal means in correspondence of a first shape 6 is represented with a solid line and indicated by the letter A; the position taken up by the removal means moving closer to the other shape 6 is represented with a dashed line and indicated by the letter B.

Figure 11A:
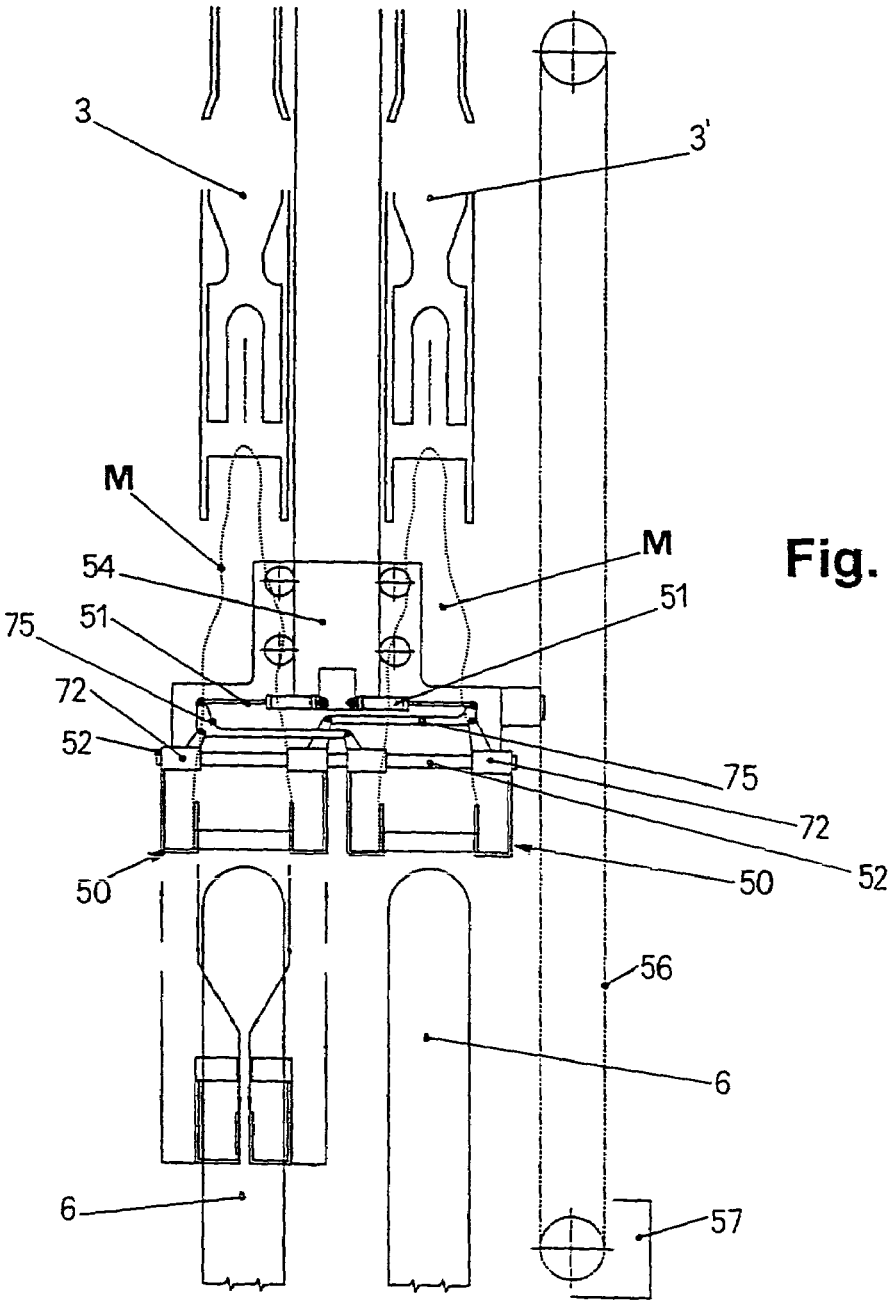
FIGS. 11A and 11B show an apparatus for loading coplanar side-by-side disposed shapes, which is provided with dual loading means according to the invention as schematically represented in front view and in plan view from above, respectively.
Figure 11B:
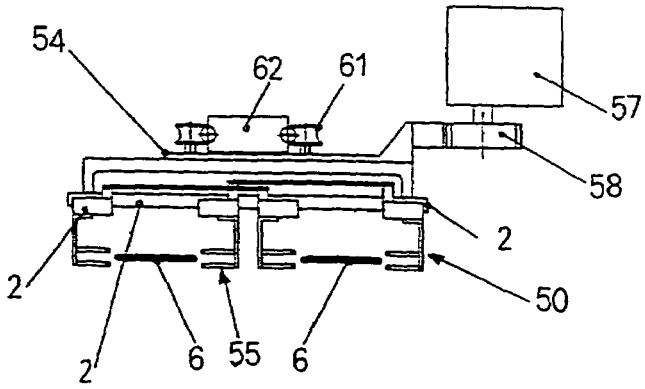

FIGS. 11A and 11B, in conclusion, show an apparatus 1 for loading coplanar, side-by-side disposed shapes, which is provided with loading means. In this exemplary embodiment, in addition to a first chamber 3 for incoming articles, provision is made for a further chamber 3' having similar characteristics. The carriage 54 is vertically movable as in the preceding examples and a horizontal guide 52 is formed thereon which, in this case, has a greater horizontal development extending across both the chambers 3 and 3'. Fitted on the guide 52 are two pairs of bushes 72, each pair being provided for supporting a corresponding removal member 50. The cylinders 51, intended for driving the removal members 50, are fixed to the carriage 54 and the respective rods are associated with connecting arms 75, one on the right side and one on the left side. The connecting arm 75 located on the left side is connected to bushes 72 of the removal members 50 disposed on the left of each shape 6; similarly, the connecting arm 75 located on the right side, is connected to bushes 72 of the two members 50 disposed on the right of shapes 6. This embodiment, therefore, makes it possible to simultaneously carry out the loading of the two coplanar, side-by-side disposed shapes, with a significant saving of time.

The members for driving and controlling the elements above described and illustrated in the drawings are of a type known to those skilled in the industrial automation and, accordingly, are not described in greater detail for the sake of simplicity. Moreover, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

What is claimed is:

1. Apparatus for loading articles onto an ironing machine which is provided with relevant support shapes, apparatus that comprises:

a tubular chamber with an inlet section for the introduction of articles, connected upstream with a supply machine able to transfer the articles according to a preset order;

a temporary support element on which the article can be fitted, said support element being located within said chamber with its longitudinal axis coincident with or parallel to that of the same chamber and subdivided into two semi-parts which can move close to and, respectively, away from each other;

means for the removal and positioning of the articles, able to remove an article from said temporary support element and to fit it onto a shape, wherein the said removal members are associated with driving means so as to result movable in parallel and transversely to the axis of the element which supports the articles, and the means for driving a clamping means comprise a first carriage movable parallel to said axis and exhibiting a guide located transversely to said axis, on which guide two skids are made to slide, each of which supports one of said removal members, provision being made for means for driving the carriage into motion parallel to said axis, and means for driving the skids into motion along the guide in order to move the removal members close to and away from each other, respectively and each skid is provided with a connection arm to which the free end of the rod, of one of two cylinders solid to the guide, is hinged, said cylinders being disposed opposite to each other, with the respective rods facing outwards.

2. The apparatus of claim 1, wherein it is provided with suction means acting in opposite directions on said chamber.

3. The apparatus of claim 2, wherein the supply machine feeds the articles with their hem portion being forward, and wherein the inlet section consists of two rollers able to retain the article arriving at said chamber; a portion of said chamber being formed like a converging-diverging conduit so as to determine, by the intervention of said suction means, the opening of the article in correspondence of the hem in order to fit the article on the support.

4. The apparatus of claim 1 wherein the two semi-parts of said temporary support element are associated with respective driving means.

5. The apparatus of claim 1, wherein one of the semi-parts is associated with driving means, the other semi-part being fixed.

6. The apparatus of claim 1, wherein the semi-parts of said temporary support element are associated with movable walls of said chamber.

7. The apparatus of claim 1, wherein one of the semi-parts of said temporary support element is associated with a movable wall of said chamber and the other semi-part is fixed.

8. The apparatus of claim 1, wherein the removal and positioning means comprise two removal members opposite to each other, each of which has two rod-like parallel elements or arms.

9. Apparatus for loading articles onto an ironing machine which is provided with relevant support shapes, apparatus that comprises:

a tubular chamber with an inlet section for the introduction of articles, connected upstream with a supply machine able to transfer the articles according to a preset order;

a temporary support element on which the article can be fitted, said support element being located within said chamber with its longitudinal axis coincident with or parallel to that of the same chamber and subdivided into two semi-parts which can move close to and, respectively, away from each other;

means for the removal and positioning of the articles, able to remove an article from said temporary support element and to fit it onto a shape, wherein the said removal members are associated with driving means so as to result movable in parallel and transversely to the axis of the element which supports the articles, and the means for driving a clamping means comprise a first carriage movable parallel to said axis and exhibiting a guide located transversely to said axis, on which guide two skids are made to slide, each of which supports one of said removal members, provision being made for means for driving the carriage into motion parallel to said axis, and means for driving the skids into motion along the guide in order to move the removal members close to and away from each other, respectively, to be used in particular for loading articles onto coplanar and side-by-side disposed shapes, wherein the said carriage is provided with an additional guide parallel to the first guide, a second carriage sliding along said additional guide and supporting the said first guide so as to allow the translation of the second carriage and first guide supported thereon, according to a direction transverse to said axis, thereby allowing shifting from one shape to another sideway disposed.

10. Apparatus for loading articles onto an ironing machine which is provided with relevant support shapes, apparatus that comprises:

a tubular chamber with an inlet section for the introduction of articles, connected upstream with a supply machine able to transfer the articles according to a preset order;

a temporary support element on which the article can be fitted, said support element being located within said chamber with its longitudinal axis coincident with or parallel to that of the same chamber and subdivided into two semi-parts which can move close to and, respectively, away from each other;

means for the removal and positioning of the articles, able to remove an article from said temporary support element and to fit it onto a shape, wherein the said removal members are associated with driving means so as to result movable in parallel and transversely to the axis of the element which supports the articles, and the means for driving a clamping means comprise a first carriage movable parallel to said axis and exhibiting a guide located transversely to said axis, on which guide two skids are made to slide, each of which supports one of said removal members, provision being made for means for driving the carriage into motion parallel to said axis, and means for driving the skids into motion along the guide in order to move the removal members close to and away from each other, respectively, to be used in particular for loading articles onto parallel, frontally paired shapes, wherein the said carriage is provided with an additional guide disposed orthogonally to said first guide and along which an additional carriage is made to slide bi-directionally by relevant driving means, said additional carriage supporting the said guide with respect to which the said removal members are movable.

11. Apparatus for loading articles onto an ironing machine which is provided with relevant support shapes, apparatus that comprises:

a tubular chamber with an inlet section for the introduction of articles, connected upstream with a supply machine able to transfer the articles according to a preset order;

a temporary support element on which the article can be fitted, said support element being located within said chamber with its longitudinal axis coincident with or parallel to that of the same chamber and subdivided into two semi-parts which can move close to and, respectively, away from each other;

means for the removal and positioning of the articles, able to remove an article from said temporary support element and to fit it onto a shape, wherein the said removal members are associated with driving means so as to result movable in parallel and transversely to the axis of the element which supports the articles, and the means for driving a clamping means comprise a first carriage movable parallel to said axis and exhibiting a guide located transversely to said axis, on which guide two skids are made to slide, each of which supports one of said removal members, provision being made for means for driving the carriage into motion parallel to said axis, and means for driving the skids into motion along the guide in order to move the removal members close to and away from each other, respectively, to be used in particular for loading more articles at a time onto corresponding shapes disposed side-by-side, wherein it comprises at least a second chamber and wherein multiple removal means are provided on said carriage.

12. The apparatus of claim 11, wherein on said carriage there is provided a guide on which pairs of skids are fitted, each pair intended for supporting a corresponding removal member.

13. A method for loading articles of stockings, socks and other apparels onto an ironing machine being provided with relevant support shapes, wherein it comprises the following operating steps:

a) fitting an article onto a temporary support element having a relevant longitudinal axis and made up of two semi-parts which are movable away from each other;

b) moving the two semi-parts of the support away from each other so as to stretch the article and thus defining, between the two semi-parts, an opening whose longitudinal axis is orthogonal to the axis of said support;

c) inserting, into the opening thus defined, a pair of clamping members which are movable parallel to said longitudinal axis and transverse to the axis of the opening, that is, transverse with respect to the driving direction of semi-parts, and moving the clamping members toward the semiparts so as to make the members interact with the article fitted onto the semi-parts;

d) moving the removal members away from each other so as to stretch the article along a direction orthogonal to the axis of the opening;

e) moving the removal members further with respect to the semi-parts so as to withdraw the article from the latter;

f) moving the removal members which carry the article in stretched configuration, onto a shape so as to fit the article onto the same shape, wherein comprise the step of translating said removal members in a direction transverse to said axis so as to fit the article onto one or more shapes disposed coplanar in side-by-side relationship.

* * * * *